United States Patent [19]

Arthur

[11] 4,381,730

[45] May 3, 1983

[54] FILTER ROD MANUFACTURE

[75] Inventor: Hugh M. Arthur, High Wycombe, England

[73] Assignee: Molins Limited, Bucks, England

[21] Appl. No.: 217,771

[22] Filed: Dec. 18, 1980

[30] Foreign Application Priority Data

Dec. 20, 1979 [GB] United Kingdom ..... 7943971

[51] Int. Cl.[3] ..... B05D 1/02; B05B 9/00

[52] U.S. Cl. ..... 118/674; 118/672; 118/692; 118/694; 118/325; 118/326; 118/DIG. 16; 427/8; 427/421; 427/424

[58] Field of Search ..... 427/421, 8, 424; 118/672, 674, 692, 694, 325, 326, DIG. 16

[56] References Cited

U.S. PATENT DOCUMENTS

| | | | |
|---|---|---|---|
| 2,981,638 | 4/1961 | Jones | 118/694 X |
| 3,156,582 | 11/1964 | Parker | 118/692 |
| 3,605,682 | 9/1971 | Groce et al. | 118/694 X |
| 3,707,859 | 1/1973 | Carr et al. | 118/694 X |
| 3,741,846 | 6/1973 | Greve | 118/325 X |
| 3,862,553 | 1/1975 | Schwemmer et al. | 118/672 X |

FOREIGN PATENT DOCUMENTS

| | | | |
|---|---|---|---|
| 2018165 | 10/1979 | United Kingdom | 118/325 |

*Primary Examiner*—Shrive P. Beck

*Attorney, Agent, or Firm*—Antonelli, Terry & Wands

[57] ABSTRACT

The application of fluid additive to a moving filter tow for production of filter rod for cigarettes, is controlled by a system which provides monitoring of rate of application of the additive by weight. Fluid additive, such as plasticizer, is pumped from a measuring cylinder to an applicator booth, excess additive draining back to the cylinder. Pressure in the cylinder is monitored by a transducer and a control circuit is provided to compare the rate of loss of additive from the cylinder (as measured by change in pressure) with a required value and adjust the supply pump by way of a motor and gearbox accordingly. Fluid additive is periodically supplied to the cylinder from a flask and reservoir.

34 Claims, 2 Drawing Figures

FILTER ROD MANUFACTURE

Figure 1:
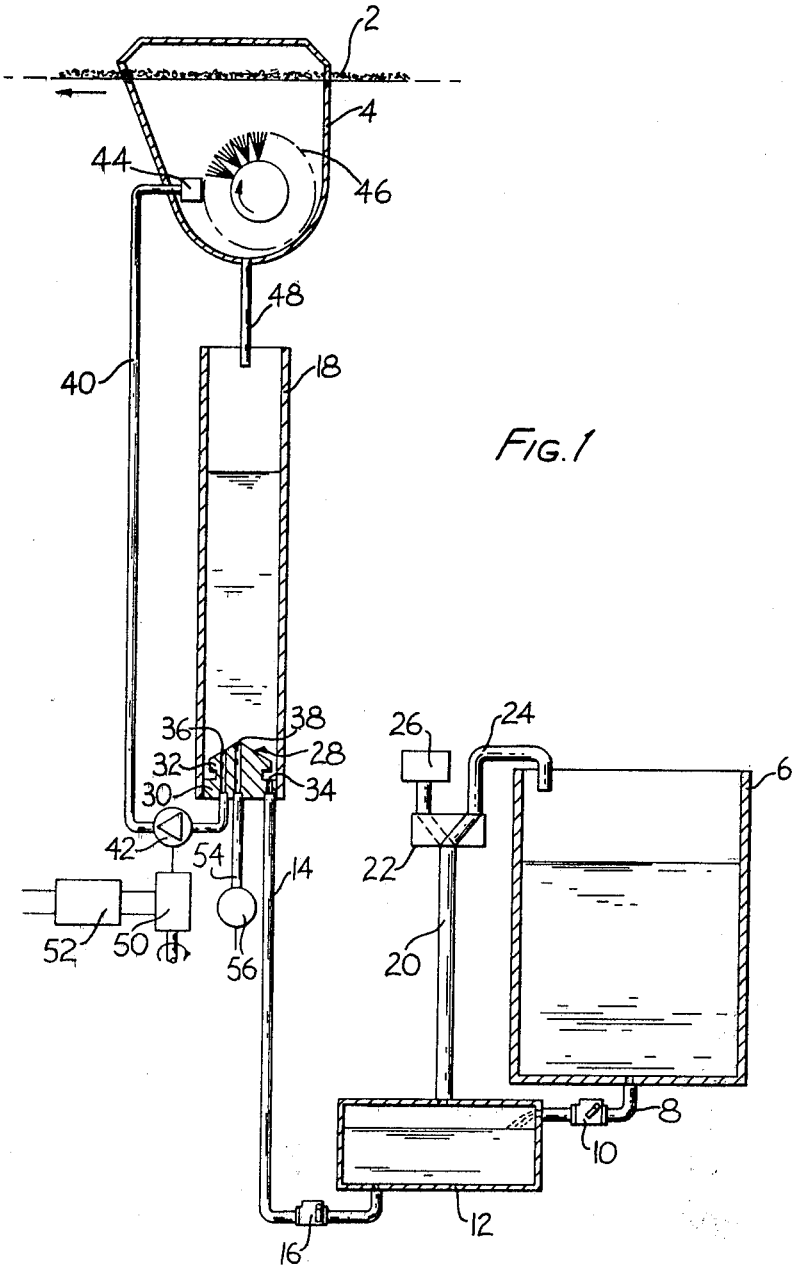

Filter rods, for making filter rods for attachment to cigarette lengths, may be made by continuously forming a tow of filter material, e.g. cellulose acetate, into a rod in a rod making machine, e.g. Molins PM5N. Conventionally a so-called plasticiser (commonly glyceryl triacetate) is added to the tow before it is passed into the rod-forming device. When cured, the plasticiser improves the properties of the finished rod by hardening it. The plasticiser may also have filtering properties.

It is desirable that the correct amount of plasticiser is added to the tow, i.e. an amount just sufficient to secure the required improvement in properties of the rod. The present invention is particularly concerned with controlling the supply of plasticiser to the tow.

Plasticiser is commonly added to the tow in an applicator booth in which the tow passes through a spray of plasticiser droplets. Plasticiser is continuously supplied to the booth at a rate which exceeds that at which it is retained by the tow and so is removed from the booth. Typically only 60% of the plasticiser supplied to the booth is captured by the tow. The remaining 40% is returned to a supply of plasticiser.

According to one aspect of the invention apparatus for applying fluid additive to a moving filter tow includes applicator means, detector means for providing measurements representative of the mass of fluid additive applied to the tow, and control means responsive to said measurements for varying the rate of application of fluid additive to the tow if it deviates from a required value. The detector means may be associated with a supply path for fluid additive to the applicator means. Returning means for fluid additive not captured by the tow may be provided and may be located so that said measurements are modified by the return flow.

The apparatus may include means for converting tow into filter rod downstream of the applicator means, and means for determining a characteristic of the filter rod or tow, wherein the control means is arranged to maintain the application rate by mass substantially constant relative to said characteristic. The characteristic may be rod length or representative of it (e.g. number of rods produced). Alternatively the characteristic may be rod mass or density.

The control means may include means for generating from said measurements a signal representative of the application rate of fluid additive to the tow, means for generating a signal representative of a required application rate, and means for comparing said signals. The control means may include means for varying at least one of said signals in accordance with signals derived from said determining means, and may further include means for varying the rate of application of fluid additive to the tow in accordance with the speed of the tow or rod.

Preferably the flow from said applicator means is varied by varying the flow from said supply means. The supply means may include means driven from a drive which has a speed dependent on the speed of movement of the tow past the applicator means. The varying means may then include ratio control means positioned between said drive and said driven means. For example, the ratio control means could comprise a positively infinitely variable gearbox. Alternatively the varying means may control the rate at which fluid is dispensed by said driven means, e.g. by varying the displacement of driven pump means. Instead of varying the flow from the supply means this may remain constant or variable only with tow speed, the flow from the applicator means being varied by controlling the proportion of the flow passing to or through the applicator means, the remaining part of this flow by-passing the applicator means and being returned to the supply means.

Fluid additive may be stored in a reservoir from which the supply means withdraws fluid and to which the receiving means returns it. Since fluid supplied to the applicator means but not retained by the tow is returned to the reservoir the loss of fluid from the reservoir is an indication of the quantity of fluid retained by the tow. The detector means may provide measurements indicative of the lost fluid additive. Preferably the detector means measures weight or pressure.

According to another aspect of the invention apparatus for applying fluid additive to a moving filter tow includes applicator means, means for supplying fluid additive to the applicator means, means for receiving fluid additive supplied to the applicator means but not retained by the tow, means for generating a signal indicative of the difference between the flow rate to said applicator means and to said receiving means, and control means responsive to said signal for varying the flow rate from the applicator means. Preferably the control means is connected so as to vary the rate of application by controlling the supplying means. The control means may vary the application rate in response to a measured characteristic, e.g. speed of the tow or filter rod produced from the tow.

The control means may include means for comparing said signal with a reference signal indicative of a desired application rate, and means for varying the flow rate from the applicator means so that the difference between said difference signal and said reference signal tends to zero. Preferably the signal generating means includes means for determining the differential flow rate by weight of fluid additive.

The means for receiving fluid additive may comprise a reservoir from which said supply means draws fluid additive. The signal generating means may include means for measuring the rate of loss of fluid additive from the reservoir. This rate of loss of fluid from the reservoir may be measured by the rate of change of level of fluid in the reservoir, e.g. by the change in level in a measuring period or by the time taken for the level to fall between predetermined values. The level of fluid in the reservoir could be detected by optical or capacitance detectors, or by float switches.

Measurement based on change of level of fluid in the reservoir gives an indication of the volume of fluid additive used. Since the density of plasticiser varies considerably with temperature and it is normally required to treat tow with a constant mass of such additive per unit tow or rod characteristic (e.g. length, mass) it is preferable to measure the mass (or weight) of fluid additive used. Similarly, different fluid additives of different densities may be more easily applied at the required rate if the control system responds directly to mass (or weight) of fluid. Thus, change of pressure of fluid in the reservoir in a measuring period may be used to indicate the lost fluid. Alternatively, this fluid may be weighed directly, e.g. by weighing the reservoir at the beginning and end of the measuring period. Instead of using a fixed measuring period the time taken for pressure or weight of fluid in the reservoir to change between fixed predetermined values may be used as an indication of rate of loss of plasticiser from the reservoir.

The quantity of additive required in a filter tow is usually constant (for a particular tow and additive) irrespective of the speed of the tow (determined by the speed of operation of the rod making machine which forms the treated tow into a filter rod). For this reason, when repeated measurements of fluid lost from a reservoir are made or, more generally, when determining said differential flow rate, it is preferred to determine the measuring period with respect to machine time rather than absolute time, so that the measurements are comparable if the speed of the tow changes. Thus each measuring period may be determined by production of a predetermined number of rods by the rod making machine of by production of a predetermined length of rod. Alternatively, it is possible that the required application rate is determined according to characteristics other than rod length, e.g. rod density or weight. Thus, in theory at least, the measuring period may be determined by the passage of a predetermined weight of tow or rod. Reference herein to flow rates may therefore be construed accordingly.

In a preferred arrangement a signal representative of said differential flow rate, e.g. loss of fluid additive from a reservoir, is compared with a value indicative of the desired rate of application of additive to the tow and a difference signal produced. The difference signal may be applied to means controlling the rate of supply to adjust it so that the measured signal and reference value approach each other. The supply means may, for example, include a pump or other means driven at a speed which is dependent on the speed of the tow but which is also variable by varying the ratio of the speed of the pump to the speed of the tow. Thus the pump may be driven through an infinitely variable gearbox from a drive derived from the main rod making machine motor, the gearbox ratio being controlled by said difference signal.

Rate of loss of fluid additive from a reservoir may be measured by taking repeated discrete measurements as the quantity of fluid in the reservoir falls. When the loss of fluid is measured by change in level or pressure it is convenient to arrange that the reservoir has a constant cross-sectional area so that the relationship between lost fluid and change in pressure or level is linear. When the quantity of fluid in the reservoir reaches a lower limit recharging becomes necessary and can readily be initiated by a signal from the measuring means. Similarly such a signal can be used to prevent overfilling of the reservoir, acting to stop the charging means when an upper limit is reached. Thus a charging pump could be switched on and off by signals from the measuring means. Alternatively, whenever charging is initiated a constant volume of fluid may be transferred to the reservoir.

Figure 2:
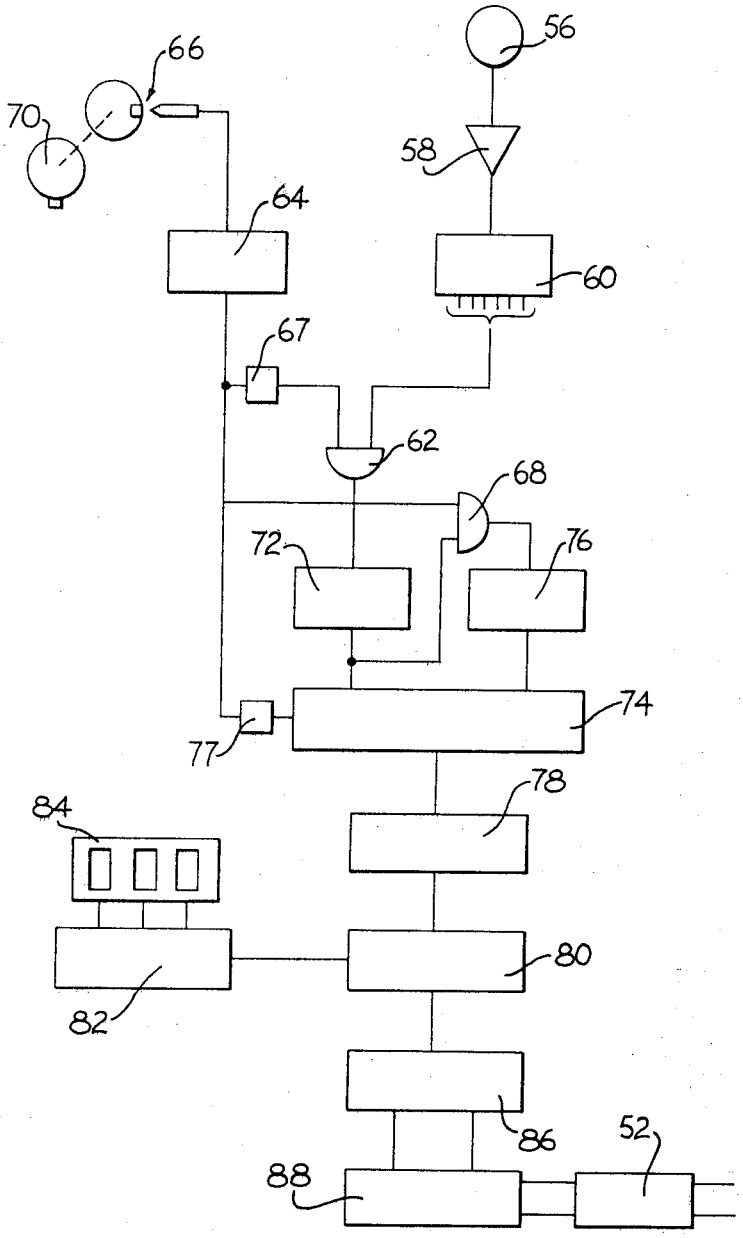

The invention will be further described, by way of example only, with reference to the accompanying diagrammatic drawings, in which:

FIG. 1 is a part sectional elevation of apparatus for applying plasticiser to a tow of filter material, and FIG. 2 shows a control system for the apparatus of FIG. 1.

The apparatus shown in FIG. 1 is associated with a filter rod making machine, such as a Molins PM5N, which forms filter tow into a continuous rod and cuts it into individual filter rod lengths. Means (not shown) are provided for continuously withdrawing a web of filter tow 2 from a supply (e.g. a bale) and moving it through a chamber 4 at a speed dependent on the operating speed of the rod making machine. Subsequently the tow 2 passes to the rod making machine.

In the chamber 4 plasticiser is applied to the moving tow 2. The plasticiser is supplied to the chamber 4 by way of a metering flow path from a reservoir 6. A pipe 8 provided with a one-way check valve 10 connects the reservoir 6 to a flask 12. A further pipe 14, provided with a one-way check valve 16, leads from the flask 12 to a metering cylinder 18. The flask 12 is also provided with an air inlet pipe 20 which leads from a two-way valve 22 connectable either to atmosphere through pipe 24 or to a source 26 of pressure air.

The metering cylinder 18 has a bottom plug 28 having an outer sealing disc 30 and an internally projecting central portion 32. A first bore 34 leads through the outer periphery of the disc 30 to a recessed annular space between the disc and the portion 32. The pipe 14 leads into the bore 34. Second and third bores 36, 38 pass through the disc 30 and portion 32. A pipe 40 including a constant displacement pump 42 leads from the second bore 36 to a distributing manifold 44 in the chamber 4.

The third bore 38 in the plug 28 is connected to a pipe 54 leading to a pressure transducer 56.

A rotary spray brush 46 is arranged in the chamber 4 with its periphery in contact with the manifold 44. A drain tube 48 leads from the bottom of the chamber 4 to the top of the metering cylinder 18.

The constant displacement pump 42 is driven through an infinitely variable gearbox 50 from a drive source having an output speed normally dependent on the speed of the tow 2. The ratio of the gearbox is controlled by a motor 52.

Plasticiser in the reservoir 6 flows through the pipe 8 into the flask 12 (and pipe 20) when the valve 22 is positioned so that the pipe 20 is vented to atmosphere through pipe 24, as shown in FIG. 1. When the flask 12 is full the metering cylinder 18 may be replenished with plasticiser by moving the valve 22 so that the pipe 20 is connected to the air pressure source 26. Plasticiser is then forced out of the flask 12 by air pressure and through the pipe 14 into the metering cylinder 18. The design of the plug 28 tends to promote a swirling motion for the introduced plasticiser and prevents loss through overspill. The valve 10 stops plasticiser passing back to the reservoir 6. The valve 16 stops reverse flow from the cylinder 18 to the flask 12 when the valve 22 vents the pipe 20 to atmosphere.

Plasticiser is taken from the cylinder 18 by the constant displacement pump 42 and fed to the manifold 44 from which it is sprayed by the rotating brush 46 onto the tow 2. Plasticiser not captured by the tow 2 drains to the bottom of the chamber 4 from which it passes back to the metering cylinder 18 through the tube 48.

The pump 42 is driven at a speed which varies with the speed of the tow 2, e.g. with the operating speed of the rod making machine. The ratio between the speed of the tow 2 and the speed of the pump 42 is adjustable through the gearbox 50. The present system allows monitoring of the quantity of plasticiser applied to the tow 2 and adjustment of the ratio of the gearbox 50 to alter the rate of supply of plasticiser to optimise this quantity. Since plasticiser not captured by the tow 2 drains back to the metering cylinder 18 through the tube 48 the quantity of plasticiser captured by the tow corresponds to the loss of plasticiser from the cylinder (at least when a steady state has been reached). The pressure transducer 56 measures this loss of plasticiser by providing pressure readings at intervals. As the cylinder 18 is of constant area over its operating height successive readings are representative of the weight of lost plasticiser during a measuring period. Several successive readings may be taken over the period during which the level of plasticiser in the cylinder 18 falls from an upper to a lower limit. These readings are compared with the desired value for the quantity of plasticiser to be applied to the tow during the measuring period and, if necessary, a signal is sent to the motor 52 to adjust the ratio of the gearbox 50 so that the speed of the pump 42 is altered to increase or decrease the supply rate of plasticiser accordingly.

A control system including a circuit linking the pressure transducer 56 and the motor 52 which controls the gearbox 50 is shown in FIG. 2. The signal from the pressure transducer 56 is fed through a buffering amplifier 58 to an analogue to digital converter 60 which provides a digital output proportional to pressure registered by the transducer. This output is fed to an AND gate 62. A counter 64 which totalises pulses provided from a motion detector 66 and generates an output whenever a predetermined number of pulses has been received is connected to AND gate 62 through a delay 67, and to a further AND gate 68. The motion detector 66 is linked to the cut-off 70 of the rod making machine.

The output of AND gate 62 is received by a register 72 which is in turn connected to an arithmetic unit 74 and also the AND gate 68. The output of the gate 68 passes to another register 76 also connected to the arithmetic unit 74. The counter 64 is connected to the unit 74 through a delay 77.

A further register 78 receives the output of the unit 74. A second arithmetic unit 80 is connected to the register 78 and also to a register 82 having a unit 84 for presetting a value in the register. Yet another register 86 is connected to the unit 80 and provides output signals to a timer 88 connected to the motor 52.

The detector 66 produces a pulse (or several pulses) for each filter rod produced by the rod making machine. When the number of pulses fed to the counter 64 reaches a predetermined value, commonly set so that the counter over-flows and resets and typically at one thousand pulses representing the same number of rods, an output pulse is provided. This initially causes the value currently in register 72 to be transferred to the register 76 via the gate 68. Fractionally later, the same pulse, having passed through delay 67, activates the gate 62 and causes the value in converter 60 to be entered in register 72. Slightly later still the arithmetic unit 74 is triggered by the same pulse through delay 77 and an output corresponding to the difference between the inputs from registers 72 and 76 is applied to the register 78 so that the value in this register represents the difference in pressure readings of the transducer 56 between pulses generated by the counter 64. In other words the value typically represents the weight of plasticiser applied to the preceding one thousand rods.

The value in register 78 is compared in the unit 80 with the desired value as provided by the register 82. The difference signal (if any) is stored in the register 86 and a signal applied to the timer 88 on one of two lines depending on the sign of the value in the register 86. The timer 88 generates an output to the motor 52 for a period proportional to the value in the register 86, the motor 52 altering the ratio of the gearbox 50 so that the rate of supply of plasticiser by the constant displacement pump 42 is changed in such a direction and by such an amount that the value in register 78 approaches the pre-set value in register 82.

Each time a pulse is generated by the counter 64 the value in the register 78 is compared with that in the register 82 so that a correction signal, if required, is applied to the motor 52. The measuring period between pulses is typically between five and twenty seconds; if the counter 64 operates for every one thousand rods the period is twelve seconds at five thousand rods per minute.

The cylinder 18 and flask 12 may each hold about one kilogram of plasticiser, which at a maximum application rate to the tow of about two hundred grams per minute represents about five minutes between charges of the cylinder. Charging may take up to about twenty seconds. Measurments during the charging period are ignored (or may not be made). Similarly, in order to allow conditions to stabilise measurements are ignored for the first minute or so after the rod making machine has been started. This avoids initially inaccurate readings as plasticiser wets the internal surfaces of the chamber 4.

The switching of the valve 22 to start and stop charging of the cylinder 18 may be controlled by the reading of the pressure transducer 56 (or, more conveniently, by that of the converter 60), which can effectively indicate the upper and lower limits for quantity of plasticiser in the cylinder. Alternatively a float switch could be provided in the cylinder 18.

Charging of the cylinder 18 could be by means other than that shown in FIG. 1. For example, a pump, piston and cylinder arrangement, or header tank could be used to supply the required quantity of plasticiser to the cylinder 18. In each case the quantity of plasticiser in the cylinder 18 can be monitored as before to control the charging operation. Plasticiser need not be introduced at the bottom of the cylinder 18 but could be introduced at the top or at any imtermediate position.

Instead of using a constant displacement pump 42 a variable displacement pump could be used, the motor 52 then being used to adjust the displacement of the pump, the gearbox 50 not normally being required. The pump may include a variable stroke piston. A suitable type manufactured by Fluid Metering Inc. has a piston stroke variable by a variable eccentric drive.

Instead of controlling the pump 42 by a gearbox 50 (or by varying its displacement) the supply of plasticiser to the manifold 44 could be controlled by installing a variable restrictor at the manifold or in the line 40. The pump 42 would then be required to supply an excess of plasticiser and a by-pass line provided from the line 40 to the reservoir 18. A variable restrictor could then be provided in the by-pass line as well as or instead of in the line 40 or at the manifold 44.

The pressure transducer 56 may be of the strain gauge type having a range of about 0–10,000 Pa. The working range of the transducer 56 may be adjusted by altering the length of the pipe 54. Suitable transducers are Bell and Howell, type BHL 4104 (75 mB gauge) or Schaevitz EM Limited, type P502/0001 (1.5 psig.).

As has been already noted, since the cylinder 18 is of constant cross sectional area the pressure transducer 56 effectively measures weight of lost plasticiser during a measuring period. This may be measured more directly by replacing the transducer with an arrangement for suspending the cylinder 18 from a weigh beam or on one or more weigh cells to obtain readings for use in the control system of FIG. 2.

The system of FIG. 2 could also be used with an input from the converter 60 responsive to the level of plasticiser in the cylinder 18, i.e. responsive to volume change. Alternatively, the time taken or number of rods produced while the level falls from predetermined upper to lower values could be used as the measured input of plasticiser application rate for comparison with a reference signal for control of the gearbox 50.

In general, while it would be possible to make measuring periods dependent on elapsed time (rather than number of rods produced) the system would then require an input for the speed of the rod making machine, e.g. to alter the preset value in register 82 in accordance with the mean speed of the rod in the measuring period. A convenient alternative would be to measure directly the length of rod produced, taking a plasticiser measurement after every ten meters, for example.

Plasticiser need not be supplied at a rate such that a predetermined constant quantity is applied to a predetermined number of length of rods. It may be required that the rate of supply of plasticiser be determined by alternative or additional characteristics and in such case the counter 64 or other device triggering the taking of readings from the transducer 56 or converter 60 may receive signals which vary with these characteristics. For example, signals representative of the speed, mass, density, weight, or pressure drop of the tow or rod or rods used or produced in a measuring period might be used. In general, for each measuring period, the quantity of plasticiser applied to the tow may be controlled such that this quantity should bear a predetermined (usually constant) relationship to the value (measured or derived from measurements) of the selected characteristic for the corresponding period. It should be noted, however, that, at least in the case where measurements of characteristics other than speed are made in the rod, any change in plasticiser application rate made as a result of the measurements can only affect rods yet to be formed; in other words, in terms of plasticiser and selected characteristic values, the measurements are not usually on corresponding sections of tow and rod. If measurements are made on the tow in or upstream of the region in which plasticiser is applied it is possible, at least in theory, to have corresponding measurements which refer to the same length of tow.

Where characteristics other than rod numbers or rod length are used to determine the rate of application of plasticiser to the tow the arrangement of FIG. 2 could still be used by modifying the target value in register 82. Thus, for example, the counter 66 could still be used to provide readings every 1,000 rods to start and finish the measuring periods but the value in register 82 could be varied for each period in accordance with signals derived from means responsive to a tow or rod characteristic (e.g. weight, mean density). In this way the ratio of weight or quantity of plasticiser applied could, if desired, be maintained constant in relation to the value of that characteristic. For example, instead of controlling plasticiser supply rate in accordance with rod speed or length, rod weight or density could be the determinative characteristic, even though each measuring period could still be determined by the counter 66. Of course, if desired, the measuring period could be determined by alternative criteria, e.g., level of plasticiser in the cylinder 18 or, simply, elapsed time without reference to machine speed.

The chamber 4 is shown diagrammatically as including a manifold 44 and spray brush 46. It should be realised that the particular form of applicator chamber is not critical, except for the provision of a drain from the chamber to the measuring cylinder 18. In particular the present arrangement may successfully be used with the applicator booth disclosed in our British patent applications Nos. 7,924,869 and 8,023,119.

Control of the tow is important in achieving uniform distribution of plasticiser through the tow. In tow processing apparatus the tow passes through two or more pairs of rolls to withdraw and convey it at a required rate. It is important to be able to set the roll nip pressure with some accuracy. One system for achieving this comprises measuring with a pressure transducer the pressure in a hydraulic or other system arranged to regulate roll pressure, comparing it with a reference value for the roll pressure, and correcting any difference by adjustment of the pressure using a pressure regulator. The ratio of the speeds of the pairs of rolls can similarly be controlled by sensing with a motion detector the actual speed of a roll, comparing it with a pre-set reference value, and adjusting the speed, if necessary, by means of a positively infinitely variable gearbox.

I claim:

1. Apparatus for making filter rod from filter tow, comprising applicator means for applying fluid additive to a moving filter tow, means defining an endless flow path for fluid additive, said applicator means being located in said path, means for supplying fluid additive to said applicator means at a controlled rate along said flow path, means for measuring the flow rate in said path downstream of said applicator means and upstream of said supplying means, means for determining a characteristic of the filter rod or tow, and control means for varying the rate of application of fluid additive in accordance with signals derived from said measuring means and said determining means.

2. Apparatus as claimed in claim 1, wherein the control means is arranged to maintain the application rate by mass substantially constant relative to said characteristic.

3. Apparatus as claimed in claim 2, wherein the characteristic is or is representative of rod length.

4. Apparatus as claimed in claim 2, wherein the characteristic is rod mass or density.

5. Apparatus as claimed in claim 2, wherein the control means includes means for generating a signal representative of the application rate of fluid additive to the tow, means for generating a signal representative of a required application rate, means for comparing said signals, and means for varying at least one of said signals in accordance with signals derived from said determining means.

6. Apparatus as claimed in claim 2 or claim 5, wherein the control means includes means for varying the rate of application of fluid additive to the tow in accordance with the speed of the tow or rod.

7. Apparatus as claimed in claim 1, wherein the control means includes means for generating a signal representative of the application rate of fluid additive to the tow, means for generating a signal representative of a required application rate, and means for comparing said signals.

8. Apparatus as claimed in claim 1, wherein said measuring means includes means for delivering signals at spaced intervals and said intervals are determined by the speed of the tow or filter rod produced from the tow.

9. Apparatus as claimed in claim 1, wherein the control means is arranged to vary said controlled rate of said supplying means.

10. Apparatus as claimed in claim 1, wherein said flow path includes a reservoir and said measuring means is arranged to measure rate of loss of fluid additive from the reservoir.

11. Apparatus as claimed in claim 10, wherein the measuring means is arranged to provide measurements representative of weight of fluid additive in the reservoir.

12. Apparatus as claimed in claim 11, wherein the measuring means includes a pressure transducer.

13. Apparatus as claimed in claim 10, further including means for periodically supplying fluid additive to said reservoir from an external source.

14. Apparatus for making filter rod from filter tow, comprising applicator means for applying fluid additive to a moving filter tow, means for measuring flow rate indicative of the rate of retention of fluid additive by the tow in a first portion of an endless flow path including said applicator means, first means for determining a first characteristic of the filter rod or tow, second means for determining a second characteristic of the filter rod or tow, and control means responsive to said measuring means and to said first and second determining means for varying the rate of application of fluid additive by varying the flow rate in a second portion of said endless flow path so that said rate has a predetermined relationship with said characteristics.

15. Apparatus as claimed in claim 14, 4, wherein the first characteristic is speed.

16. Apparatus as claimed in claim 14 or claim 15, wherein the second characteristic is rod mass or density.

17. Apparatus for making filter rod from filter tow, including applicator means for applying fluid additive to a moving filter tow, a reservoir for fluid additive, means for supplying fluid additive from the reservoir to the applicator means, means for returning to the reservoir fluid additive supplied by said supplying means but not retained by the tow, means for measuring the rate of loss of fluid additive from the reservoir, means for determining a characteristic of the filter rod or tow, and control means for varying the rate of application of fluid additive in accordance with signals derived from the measuring means and the determining means, wherein said control means includes means for varying the flow from said applicator means by varying the flow from said supplying means.

18. Apparatus as claimed in claim 17, wherein the characteristic is speed and the control means includes a speed sensing device.

19. Apparatus as claimed in claim 17, wherein the control means includes means for comparing said signal with a reference signal indicative of a desired flow rate, and means for varying the flow rate from the applicator means so that the difference between said difference signal and said reference signal tends to zero.

20. Apparatus as claimed in claim 19, wherein the measuring means includes means for determining the flow rate by weight of fluid additive.

21. Apparatus as claimed in claim 20, wherein said determining means includes pressure sensing means.

22. Apparatus as claimed in claim 17, wherein the measuring means includes means for delivering signals at spaced intervals.

23. Apparatus as claimed in claim 22, wherein said measuring means includes means for comparing measurements of fluid additive quantity at said intervals.

24. Apparatus as claimed in claim 17, wherein the reservoir has a measuring region of substantially constant cross-sectional area.

25. Apparatus as claimed in claim 17, including means for sensing a low quantity of fluid additive in the reservoir and for recharging said reservoir from an external source of said additive.

26. Apparatus for making filter rod from filter tow, comprising applicator means for applying fluid additive to a moving filter tow; a reservoir for fluid additive; means for supplying fluid additive from the reservoir to the applicator means; means for returning to the reservoir fluid additive supplied by said supplying means but not retained by the tow; means for measuring the rate of loss of fluid additive from the reservoir; and control means for varying the rate of application of fluid additive in response to the output of said measuring means by varying the flow from said supplying means, including generating means for generating sequential timing signals, first storage means responsive to said timing signals from said generating means for storing the output of said measuring means, second storage means responsive to said timing signals from said generating means for storing the contents of said first storage means, arithmetic means responsive to said timing signals from said generating means for comparing the contents of said first and second storage means, and means responsive to said arithmetic means for controlling the rate of supply of fluid additive to said applicator means by said supplying means.

27. Apparatus as claimed in claim 26, wherein said generating means comprises means for producing clock signals at a frequency proportional to the speed of said moving filter tow and counter means for counting said clock pulses and producing a timing signal each time a predetermined count is reached.

28. Apparatus as claimed in claim 26, wherein said means for controlling the rate of supply of fluid additive includes second arithmetic means for comparing the output of said first-mentioned arithmetic means to a reference value and for producing an output representing the difference between the compared values and time means responsive to the output of said second arithmetic means for controlling said supplying means.

29. Apparatus for making filter rod from filter tow, comprising applicator means for applying fluid additive to a moving filter tow; a reservoir for fluid additive; means for supplying fluid additive from the reservoir to the applicator means; means for returning to the reservoir fluid additive supplied by said supplying means but not retained by the tow; means for measuring the rate of loss of fluid additive from the reservoir; and control means for varying the rate of application of fluid additive in response to the output of said measuring means, including generating means for generating sequential timing signals, first storage means responsive to said timing signals from said generating means for storing the output of said measuring means, second storage means responsive to said timing signals from said generating means for storing the contents of said first storage means, arithmetic means responsive to said timing signals from said generating means for comparing the contents of said first and second storage means, and means responsive to said arithmetic means for controlling the rate of supply of fluid additive to said applicator means by said supplying means, wherein said first storage means includes a first register and first gate means connected to said first register for transferring the output of said measuring means to said first register a first predetermined delay time after generation of a timing signal by said generating means, and said second storage means includes a second register and second gate means connected to said first and second registers for transferring the contents of said first register to said second register upon generation of a timing signal and before the output of said measuring means is transferred to said first register.

30. Apparatus as claimed in claim 29, wherein said generating means comprises means for producing clock signals at a frequency proportional to the speed of said moving filter tow and counter means for counting said clock pulses and producing a timing signal each time a predetermined count is reached.

31. Apparatus as claimed in claim 29, wherein said means for controlling the rate of supply of fluid additive includes second arithmetic means for comparing the output of said first-mentioned arithmetic means to a reference value and for producing an output representing the difference between the compared values and timer means responsive to the output of said second arithmetic means for controlling said supplying means.

32. Apparatus as claimed in claims 31 or 28, wherein said generating means comprises means for producing clock signals at a frequency proportional to the speed of said moving filter tow and counter means for counting said clock pulses and producing a timing signal each time a predetermined count is reached.

33. Apparatus as claimed in claims 31 or 28, further including means connected to said second arithmetic means for generating said reference signal on the basis of a detected characteristic of said filter rod or tow.

34. Apparatus for making filter rod from filter tow, including applicator means for applying fluid additive to a moving filter tow, a reservoir for fluid additive, means for supplying fluid additive from the reservoir to the applicator means, means for returning to the reservoir fluid additive supplied by said supplying means but not retained by the tow, means for measuring the rate loss of fluid additive from the reservoir, means for determining a characteristic of the filter rod or tow, and control means for varying the rate of application of fluid additive in accordance with signals derived from the measuring means and the determining means, wherein said measuring means includes means for delivering signals at spaced intervals and said intervals are determined by the speed of the tow.

* * * * *